US009927756B2

(12) United States Patent
Takaya et al.

(10) Patent No.: US 9,927,756 B2
(45) Date of Patent: Mar. 27, 2018

(54) IMAGE FORMING APPARATUS, IMAGE FORMATION SYSTEM, DENSITY-UNEVENNESS CORRECTION METHOD AND RECORDING MEDIUM

(71) Applicant: Konica Minolta, Inc., Tokyo (JP)

(72) Inventors: Shunichi Takaya, Tokyo (JP); Makoto Ikeda, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/282,070

(22) Filed: Sep. 30, 2016

(65) Prior Publication Data

US 2017/0102659 A1 Apr. 13, 2017

(30) Foreign Application Priority Data

Oct. 8, 2015 (JP) ..... 2015-200069

(51) Int. Cl.
*G03G 15/00* (2006.01)

(52) U.S. Cl.
CPC ..... *G03G 15/556* (2013.01); *G03G 15/5058* (2013.01); *G03G 2215/00059* (2013.01)

(58) Field of Classification Search
CPC ..... G03G 15/556; G03G 15/5058; G03G 2215/00029–2215/00042; G03G 2215/00059
See application file for complete search history.

(56) References Cited

U.S. PATENT DOCUMENTS

2012/0099165 A1* 4/2012 Omori ..... G03G 15/5058 358/475
2012/0195650 A1* 8/2012 Ogawa ..... G03G 15/0189 399/301
2013/0243459 A1* 9/2013 Omori ..... G03G 15/5058 399/49
2013/0302052 A1* 11/2013 Iwata ..... G03G 13/04 399/49

FOREIGN PATENT DOCUMENTS

JP 2012088522 A 5/2012
JP 2013-235167 A 11/2013
JP 2013-235169 A 11/2013

OTHER PUBLICATIONS

Notice of Reasons for Rejection dated Aug. 22, 2017 from corresponding Japanese Patent Application No. JP 2015-200069 and English translation.

* cited by examiner

*Primary Examiner* — Carla Therrien
(74) *Attorney, Agent, or Firm* — Lucas & Mercanti, LLP

(57) ABSTRACT

An image forming apparatus includes an image forming section; a density detection section configured to detect the density of toner image formed on an image bearing member in a sub scanning direction; and a density-unevenness correction section configured to calculate a first correction amount based on the detection result of the density detection section and calculate a second correction amount different from the first correction amount in phase.

13 Claims, 8 Drawing Sheets

IMAGE FORMING APPARATUS, IMAGE FORMATION SYSTEM, DENSITY-UNEVENNESS CORRECTION METHOD AND RECORDING MEDIUM

CROSS REFERENCE TO RELATED APPLICATIONS

This application is entitled to and claims the benefit of Japanese Patent Application No. 2015-200069, filed on Oct. 8, 2015, the disclosure of which including the specification, drawings and abstract is incorporated herein by reference in its entirety.

BACKGROUND OF THE INVENTION

1. Field of the Invention

The present invention relates to an image forming apparatus, an image formation system, a density-unevenness correction method and a recording medium.

2. Description of Related Art

In general, an electrophotographic image forming apparatus (such as a printer, a copy machine, and a fax machine) is configured to irradiate (expose) a charged photoconductor with (to) laser light based on image data to form an electrostatic latent image on the surface of the photoconductor. The electrostatic latent image is then visualized by supplying toner from a developing device to a photoconductor drum (image carrier) on which the electrostatic latent image is formed, whereby a toner image is formed. Further, the toner image is directly or indirectly transferred to a sheet, and then heat and pressure are applied to the sheet at a fixing nip to form a toner image on the sheet.

Incidentally, it is known that, in the image forming apparatus, cyclic density unevenness is caused in the sub scanning direction of the image due to the rotation runout of the photoconductor drum and the developing roller (developer bearing member). FIG. 1 illustrates sheet S in which density unevenness of output image S1 is caused.

When such density unevenness is caused, first portion S11 having a high color density and second portion S12 having a low color density are alternately formed in output image S1 when an image composed of one color is output to sheet S as illustrated in FIG. 1, for example. In particular, in the case of density unevenness due to the rotation runout of developing roller, first portion S11 and second portion S12 are formed at short intervals since the diameter of the developing roller is smaller than the diameter of the photoconductor drum. Therefore, when density unevenness due to the rotation runout of the developing roller is caused, the density unevenness tends to be reflected in the image output on the sheet, and consequently precise correction of the density unevenness becomes necessary.

For example, Japanese Patent Application Laid-Open No. 2012-88522 discloses a technique of correcting density unevenness in the sub scanning direction and the main scanning direction based on the rotation cycle of the image bearing member and the detection signal of the density detection section. In this technique, density unevenness is corrected by detecting the density unevenness in the sub scanning direction, determining the correction pattern, and applying the correction pattern at all positions in the main scanning direction.

However, when the positions of the holding parts of the both end portions of the developing roller in the direction of the rotation axis in the developing device are shifted, the developing roller is tilted to the photoconductor drum. FIG. 2 illustrates sheet S in which density unevenness tilted to the main scanning direction is caused. As illustrated in FIG. 2, in this state, when density unevenness is caused due to rotation runout of the developing roller, first portion S11 and second portion S12 in output image S1 are tilted to the main scanning direction (hereinafter referred to as "tilted density unevenness").

In the configuration disclosed in Japanese Patent Application Laid-Open No. 2012-88522, the same correction pattern is applied at all positions in the main scanning direction. Consequently, elimination of the density unevenness at all of position A, position B, position C and so forth in the main scanning direction (see FIG. 2) cannot be achieved, and density-unevenness correction for the tilted density unevenness cannot be precisely performed.

SUMMARY OF THE INVENTION

An object of the present invention is to provide an image forming apparatus, an image formation system, a density-unevenness correction method and a recording medium which can precisely correct density unevenness due to rotation runout of the developer bearing member.

To achieve the abovementioned object, an image forming apparatus reflecting one aspect of the present invention includes: an image forming section including an image bearing member and a developer bearing member configured to supply toner to the image bearing member, the image forming section being configured to attach the toner to the image bearing member to form a toner image; a density detection section configured to detect density in a sub scanning direction of the toner image formed on the image bearing member at a plurality of positions in a main scanning direction orthogonal to the sub scanning direction, the sub scanning direction being a rotational direction of the image bearing member; and a density-unevenness correction section configured to perform a first correction process in which a first correction amount is calculated based on a detection result of the density detection section and a second correction amount is calculated based on a difference between the calculated first correction amount and the detection result of the density detection section at the plurality of positions, the first correction amount being configured for correcting density unevenness of the toner image caused in the sub scanning direction, the second correction amount being a correction amount for correcting density unevenness of the toner image at a plurality of main scanning positions in the main scanning direction, the second correction amount being different from the first correction amount in phase.

Desirably, in the image forming apparatus, the density-unevenness correction section performs a second correction process in which the second correction amount is calculated based on the calculated first correction amount and a detection result of the density detection section on a second toner image which differs from a first toner image which is used to perform the first correction process.

Desirably, in the image forming apparatus, the density-unevenness correction section controls the image forming section such that a length of the second toner image in the sub scanning direction is smaller than a length of the first toner image in the sub scanning direction.

Desirably, the image forming apparatus further comprising a cycle detection section configured to detect a rotation cycle of the developer bearing member. A plurality of the density detection sections are disposed side by side in the main scanning direction; and the density-unevenness correction section detects correction amounts of respective positions of the density detection sections in the main scanning direction based on a rotation cycle detected by the cycle detection section and detection results of the density detection sections, and calculates a correction amount of positions where the density detection sections are not disposed based on the detected correction amounts.

Desirably, in the image forming apparatus, the density-unevenness correction section calculates the first correction amount based on the rotation cycle detected by the cycle detection section and at least one of the detection results of the density detection sections.

Desirably, in the image forming apparatus, the density-unevenness correction section calculates the first correction amount to eliminate the density unevenness of the detection results of the density detection section.

To achieve the abovementioned object, an image formation system composed of a plurality of units reflecting one aspect of the present invention includes an image forming apparatus, the image formation system including: an image forming section including an image bearing member and a developer bearing member configured to supply toner to the image bearing member, the image forming section being configured to attach the toner to the image bearing member to form a toner image; a density detection section configured to detect density in a sub scanning direction of the toner image formed on the image bearing member at a plurality of positions in a main scanning direction orthogonal to the sub scanning direction, the sub scanning direction being a rotational direction of the image bearing member; and a density-unevenness correction section configured to perform a first correction process in which a first correction amount is calculated based on a detection result of the density detection section and a second correction amount is calculated based on a difference between the calculated first correction amount and the detection result of the density detection section at the plurality of positions, the first correction amount being configured for correcting density unevenness of the toner image caused in the sub scanning direction, the second correction amount being a correction amount for correcting density unevenness of the toner image at a plurality of main scanning positions in the main scanning direction, the second correction amount being different from the first correction amount in phase.

To achieve the abovementioned object, in a density-unevenness correction method reflecting one aspect of the present invention which is used in an image forming apparatus including an image forming section including an image bearing member and a developer bearing member configured to supply toner to the image bearing member, the image forming section being configured to attach the toner to the image bearing member to form a toner image, the method including: detecting density in a sub scanning direction of the toner image formed on the image bearing member at a plurality of positions in a main scanning direction orthogonal to the sub scanning direction, the sub scanning direction being a rotational direction of the image bearing member; and performing a first correction process in which a first correction amount is calculated based on a detection result of the density and a second correction amount is calculated based on a difference between the calculated first correction amount and the detection result of the density at the plurality of positions, the first correction amount being configured for correcting density unevenness of the toner image caused in the sub scanning direction, the second correction amount being a correction amount for correcting density unevenness of the toner image at a plurality of main scanning positions in the main scanning direction, the second correction amount being different from the first correction amount in phase.

Desirably, in the density-unevenness correction method, a second correction process in which the second correction amount is calculated based on the calculated first correction amount and a detection result of the density on a second toner image which differs from a first toner image which is used to perform the first correction process is performed.

Desirably, in the density-unevenness correction method, the image forming section is controlled such that a length of the second toner image in the sub scanning direction is smaller than a length of the first toner image in the sub scanning direction.

Desirably, the density-unevenness correction method further includes detecting a rotation cycle of the developer bearing member. Correction amounts of respective positions in the main scanning direction are detected based on a detected rotation cycle and detection results of the density, and a correction amount of positions where the density is not detected is calculated based on the detected correction amounts.

Desirably, in the density-unevenness correction method, the first correction amount is calculated based on the detected rotation cycle and at least one of the detection results of the density.

Desirably, in the density-unevenness correction method, the first correction amount is calculated to eliminate the density unevenness of the detection results of the density.

To achieve the abovementioned object, in a computer-readable recording medium reflecting one aspect of the present invention which stores a program of an image forming apparatus including an image forming section including an image bearing member and a developer bearing member configured to supply toner to the image bearing member, the image forming section being configured to attach the toner to the image bearing member to form a toner image, wherein the recording medium causes a computer of the image forming apparatus to detect density in a sub scanning direction of the toner image formed on the image bearing member at a plurality of positions in a main scanning direction orthogonal to the sub scanning direction, the sub scanning direction being a rotational direction of the image bearing member; and perform a first correction process in which a first correction amount is calculated based on a detection result of the density and a second correction amount is calculated based on a difference between the calculated first correction amount and the detection result of the density at the plurality of positions, the first correction amount being configured for correcting density unevenness of the toner image caused in the sub scanning direction, the second correction amount being a correction amount for correcting density unevenness of the toner image at a plurality of main scanning positions in the main scanning direction, the second correction amount being different from the first correction amount in phase.

Desirably, in the recording medium, the recording medium causes the computer of the image forming apparatus to perform a second correction process in which the second correction amount is calculated based on the calculated first correction amount and a detection result of the density on a second toner image which differs from a first toner image which is used to perform the first correction process.

Desirably, in the recording medium, the recording medium causes the computer of the image forming apparatus to control the image forming section such that a length of the second toner image in the sub scanning direction is smaller than a length of the first toner image in the sub scanning direction.

Desirably, in the recording medium, the recording medium causes the computer of the image forming apparatus to detect a rotation cycle of the developer bearing member, and detect correction amounts of respective positions in the main scanning direction based on a detected rotation cycle and detection results of the density, and calculate a correction amount of positions where the density is not detected based on the detected correction amounts.

Desirably, in the recording medium, the recording medium causes the computer of the image forming apparatus to calculate the first correction amount based on the detected rotation cycle and at least one of the detection results of the density.

Desirably, in the recording medium, the recording medium causes the computer of the image forming apparatus to calculate the first correction amount to eliminate the density unevenness of the detection results of the density.

DESCRIPTION OF THE PREFERRED EMBODIMENTS

Figure 3:
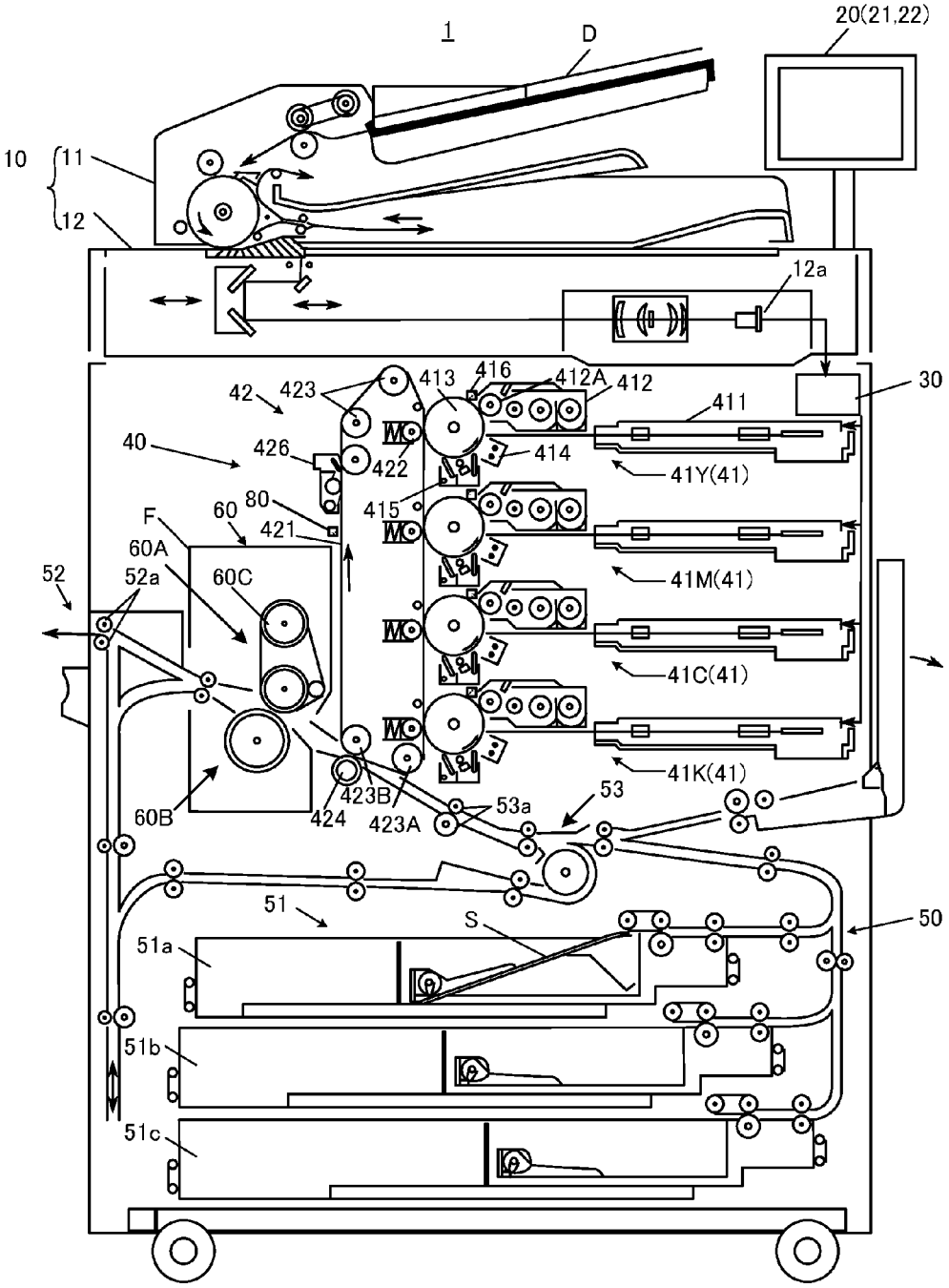
FIG. 3 schematically illustrates a general configuration of an image forming apparatus of an embodiment.
Figure 4:
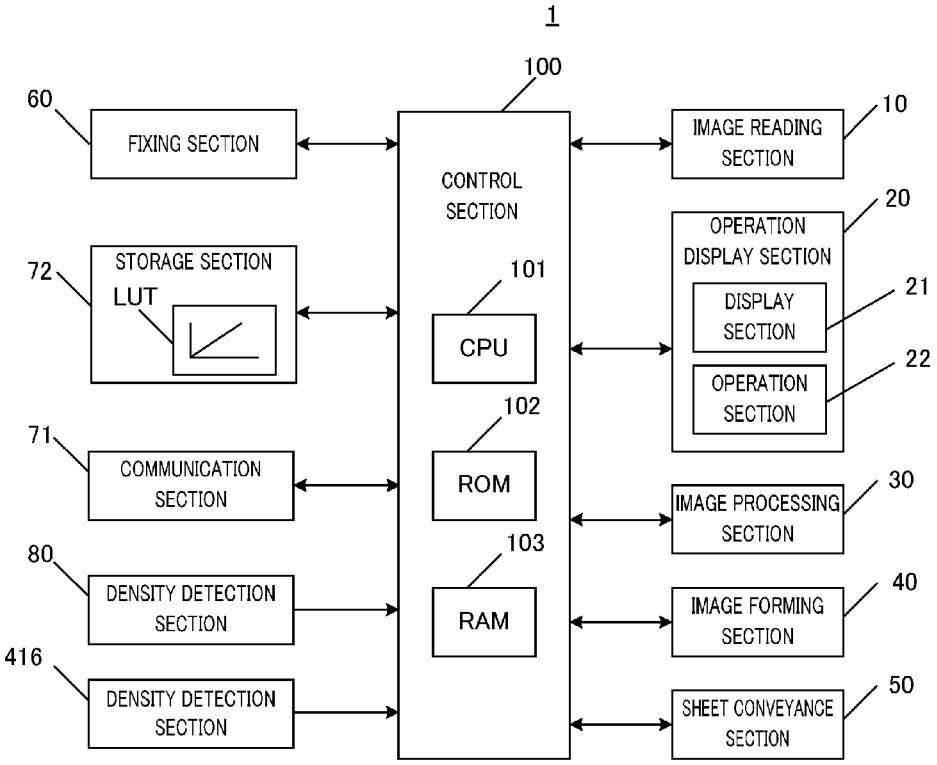
FIG. 4 illustrates a principal part of a control system of the image forming apparatus of the embodiment.

In the following, the present embodiment is described Specifically with reference to the drawings. FIG. 3 illustrates an overall configuration of image forming apparatus 1 according to the embodiment of the present invention. FIG. 4 illustrates a principal part of a control system of image forming apparatus 1 according to the embodiment of the present invention.

Image forming apparatus 1 illustrated in FIGS. 3 and 4 is a color image forming apparatus of an intermediate transfer system using electrophotographic process technology. That is, image forming apparatus 1 primary-transfers toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 1 secondary-transfers the resultant image to sheet S, to thereby form an image.

A longitudinal tandem system is adopted for image forming apparatus 1. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

Image forming apparatus 1 includes image reading section 10, operation display section 20, image processing section 30, image forming section 40, sheet conveyance section 50, fixing section 60, density detection section 80 and control section 100. Control section 100 corresponds to "density-unevenness correction section" of the embodiment of the present invention.

Control section 100 includes central processing unit (CPU) 101, read only memory (ROM) 102, random access memory (RAM) 103 and the like. CPU 101 reads a program suited to processing contents out of ROM 102, develops the program in RAM 103, and integrally controls an operation of each block of image forming apparatus 1 in cooperation with the developed program. At this time, CPU 101 refers to various kinds of data stored in storage section 72. Storage section 72 is composed of, for example, a non-volatile semiconductor memory (so-called flash memory) or a hard disk drive.

Control section 100 transmits and receives various data to and from an external apparatus (for example, a personal computer) connected to a communication network such as a local area network (LAN) or a wide area network (WAN), through communication section 71. Control section 100 receives, for example, image data transmitted from the external apparatus, and performs control to form an image on sheet S on the basis of the image data (input image data). Communication section 71 is composed of, for example, a communication control card such as a LAN card.

Image reading section 10 includes auto document feeder (ADF) 11, document image scanning device 12 (scanner), and the like.

Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and brings light reflected from the document into an image on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

Operation display section 20 includes, for example, a liquid crystal display (LCD) provided with a touch panel, and functions as display section 21 and operation section 22. Display section 21 displays various operation screens, image conditions, operating statuses of functions, and the like in accordance with display control signals received from control section 100. Operation section 22 includes various operation keys such as numeric keys and a start key, receives various input operations performed by a user, and outputs operation signals to control section 100.

Image processing section 30 includes a circuit which performs a digital image process suited to initial settings or user settings on the input image data, and the like. For example, image processing section 30 performs tone correction on the basis of tone correction data (tone correction table), under the control of control section 100. In addition to the tone correction, image processing section 30 also performs various correction processes such as color correction and shading correction as well as a compression process, on the input image data. Image forming section 40 is controlled on the basis of the image data which has been subjected to these processes.

Image forming section 40 includes: image forming units 41Y, 41M, 41C, and 41K which form images of colored toners of a Y component, an M component, a C component, and a K component on the basis of the input image data; intermediate transfer unit 42; and the like.

Image forming units 41Y, 41M, 41C, and 41K for the Y component, the M component, the C component, and the K component have similar configurations. For ease of illustration and description, common elements are denoted by the same reference signs. Only when elements need to be discriminated from one another, Y, M, C, or K is added to their reference signs. In FIG. 3, reference signs are given to only the elements of image forming unit 41Y for the Y component, and reference signs are omitted for the elements of other image forming units 41M, 41C, and 41K.

Image forming unit 41 includes exposing device 411, developing device 412, photoconductor drum 413 (corresponding to "image bearing member" of the embodiment of the present invention), charging device 414, drum cleaning device 415 and the like.

Photoconductor drum 413 is a negative-charging type organic photoconductor (OPC) having photoconductivity in which an undercoat layer (UCL), a charge generation layer (CGL), and charge transport layer (CTL) are sequentially stacked on a peripheral surface of a conductive cylindrical body made of aluminum (aluminum raw pipe), for example.

Charging device 414 causes corona discharge to evenly negatively charge the surface of photoconductor drum 413 having photoconductivity.

Exposure device 411 is composed of, for example, a semiconductor laser, and configured to irradiate photoconductor drum 413 with laser light corresponding to the image of each color component. The positive charge is generated in the charge generation layer of photoconductor drum 413 and is transported to the surface of the charge transport layer, whereby the surface charge (negative charge) of photoconductor drum 413 is neutralized. An electrostatic latent image of each color component is formed on the surface of photoconductor drum 413 by the potential difference from its surroundings.

Developing device 412 is a developing device of a two-component reverse type, and attaches toners of respective color components to the surface of photoconductor drums 413, and visualizes the electrostatic latent image to form a toner image. Developing sleeve 412A (corresponding to "developer bearing member" of the embodiment of the present invention) of developing device 412 bears developer while rotating, and supplies the toner contained in the developer to photoconductor drum 413, thereby forming a toner image on the surface of photoconductor drum 413.

In addition, cycle detection section 416 configured to detect the rotation cycle of developing sleeve 412A is provided in a region around developing sleeve 412A. Cycle detection section 416 is configured to detect the home position on developing sleeve 412A for example. Specifically, after detecting the home position of cycle detection section 416, developing sleeve 412A again detects the home position after one rotation of developing sleeve 412A. In this manner, cycle detection section 416 detects the rotation cycle of one cycle of developing sleeve 412A. Cycle detection section 416 outputs the rotation cycle to control section 100.

Drum cleaning device 415 includes a drum cleaning blade which is brought into sliding contact with the surface of photoconductor drum 413, and removes residual toner which remains on the surface of photoconductor drum 413 after the primary transfer.

Intermediate transfer unit 42 includes intermediate transfer belt 421, primary transfer roller 422, a plurality of support rollers 423, secondary transfer roller 424, belt cleaning device 426 and the like.

Intermediate transfer belt 421 is composed of an endless belt, and is stretched around the plurality of support rollers 423 in a loop form. At least one of the plurality of support rollers 423 is composed of a driving roller, and the others are each composed of a driven roller. When driving roller rotates, intermediate transfer belt 421 travels in the direction of the arrow at a constant speed.

Figure 1:
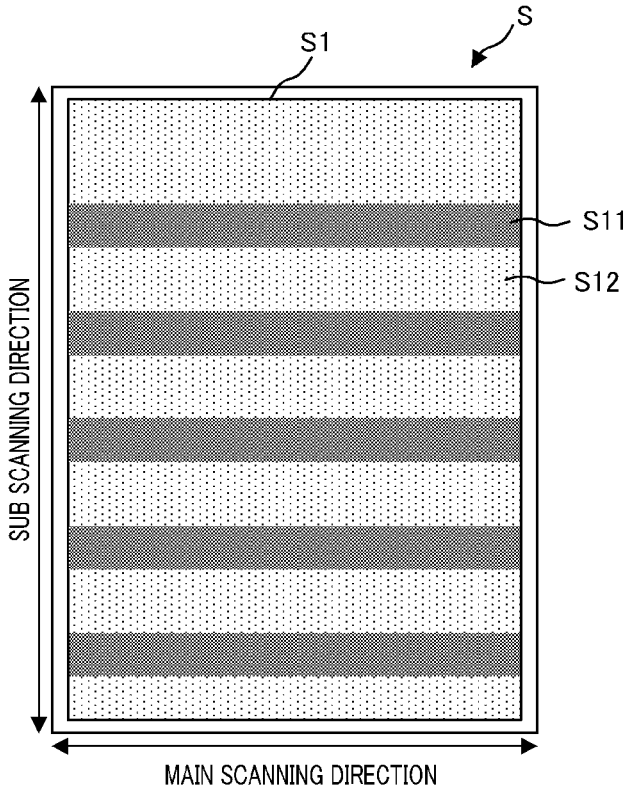
FIG. 1 illustrates a state where density unevenness of an output image is caused.
Figure 2:
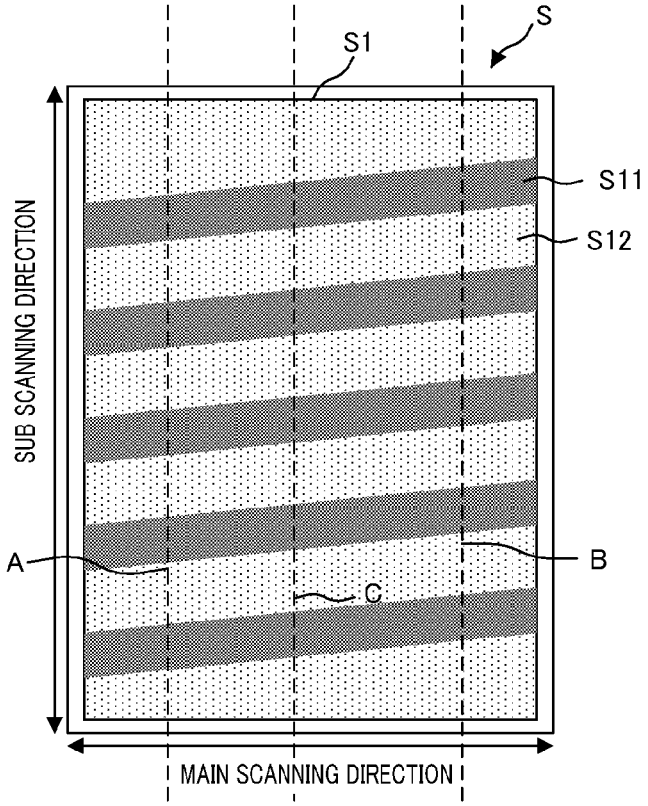
FIG. 2 illustrates a sheet in which density unevenness tilted to a main scanning direction is caused.

Two density detection sections 80 are provided at positions corresponding to the outer peripheral surface of intermediate transfer belt 421, or to be more specific, at positions corresponding to position A and position B in the main scanning direction of sheet S in FIG. 2. Density detection section 80 detects the density of a patch image formed on the surface of photoconductor drum 413 and transferred to intermediate transfer belt 421, that is, the density in the sub scanning direction, which is the rotational direction of photoconductor drum 413. The patch image corresponds to "toner image" of the embodiment of the present invention. It is to be noted that, in FIG. 1 and FIG. 2, the vertical direction of sheet S is indicated as the sub scanning direction for the purpose of describing the state of density unevenness of output image S1.

Density detection section 80 detects the quantity of reflection light from a patch image formed on the outer peripheral surface of intermediate transfer belt 421, and outputs the detected quantity of reflection light to control section 100. The patch image is formed by image forming section 40 with the rotation of intermediate transfer belt 421 in such a manner as to face density detection section 80.

Density detection section 80 may be a light sensor including a light emitting element such as light-emitting diode (LED), or a photodetector such as a photodiode (PD), for example. Density detection section 80 irradiates the surface of intermediate transfer belt 421 with light, and detects the amount of returned light (the amount of reflected light). As the toner adhesion amount of the patch image formed on intermediate transfer belt 421 increases, the amount of the applied light blocked by the patch image increases, and the amount of the light received by the photodetector decreases. As a result, the amount of the reflected light decreases, and the sensor output value output from density detection section 80 decreases. Conversely, as the toner adhesion amount of the patch image formed on intermediate transfer belt 421 decreases, the amount of returned light which has been reflected by intermediate transfer belt 421 increases. As a result, the amount of the light received by the photodetector increases, and the amount of the sensor output value output from density detection section 80 increases.

Intermediate transfer belt 421 is a belt having conductivity and elasticity which includes on the surface thereof a high resistance layer having a volume resistivity of 8 to 11 [ log Ω·cm]. Intermediate transfer belt 421 is rotationally driven by a control signal from control section 100. It is to be noted that the material, thickness and hardness of intermediate transfer belt 421 are not limited as long as intermediate transfer belt 421 has conductivity and elasticity.

Primary transfer rollers 422 are disposed on the inner periphery side of intermediate transfer belt 421 to face photoconductor drums 413 of respective color components. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face backup roller 423B disposed on the downstream side in the belt travelling direction relative to driving roller 423A, at a position on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to sheet S is formed.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and an electric charge of the polarity opposite to the polarity of the toner is applied to the rear side (the side which makes contact with primary transfer rollers 422) of intermediate transfer belt 421, whereby the toner image is electrostatically transferred to intermediate transfer belt 421.

Thereafter, when sheet S passes through the secondary transfer nip, the toner image on intermediate transfer belt 421 is secondary-transferred to sheet S. To be more specific, a secondary transfer bias is applied to secondary transfer roller 424, and an electric charge of the polarity opposite to the polarity of the toner is applied to the rear side (the side which makes contact with secondary transfer roller 424) of sheet S, whereby the toner image is electrostatically transferred to sheet S. Sheet S on which the toner images have been transferred is conveyed toward fixing section 60.

Belt cleaning device 426 removes transfer residual toner which remains on the surface of intermediate transfer belt 421 after a secondary transfer. A configuration in which a secondary transfer belt is installed in a stretched state in a loop form around a plurality of support rollers including a secondary transfer roller, that is, so-called belt-type secondary transfer unit may also be adopted in place of secondary transfer roller 424.

Fixing section 60 includes upper fixing section 60A having a fixing side member disposed on a fixing surface (the surface on which a toner image is formed) side of sheet S, lower fixing section 60B having a back side supporting member disposed on the rear surface (the surface opposite to the fixing surface) side of sheet S, heating source 60C, and the like. The back side supporting member is brought into pressure contact with the fixing side member, whereby a fixing nip for conveying sheet S in a tightly sandwiching manner is formed.

At the fixing nip, fixing section 60 applies heat and pressure to sheet S on which a toner image has been secondary-transferred to fix the toner image on sheet S. Fixing section 60 is disposed as a unit in fixing part F. In addition, fixing part F may be provided with an air-separating unit which blows air to separate sheet S from the fixing side member or the back side supporting member.

Sheet conveyance section 50 includes sheet feeding section 51, sheet ejection section 52, conveyance path section 53 and the like. Three sheet feed tray units 51*a* to 51*c* included in sheet feeding section 51 store sheets S (standard sheets, special sheets) discriminated on the basis of the basis weight, the size, and the like, for each type set in advance. Conveyance path section 53 includes a plurality of pairs of conveyance rollers such as a pair of registration rollers 53*a*.

Sheets S stored in sheet tray units 51*a* to 51*c* are output one by one from the uppermost, and conveyed to image forming section 40 by conveyance path section 53. At this time, the registration roller section in which the pair of registration rollers 53*a* are arranged corrects skew of sheet S fed thereto, and the conveyance timing is adjusted. Then, in image forming section 40, the toner image on intermediate transfer belt 421 is secondary-transferred to one side of sheet S at one time, and a fixing process is performed in fixing section 60. Sheet S on which an image has been formed is ejected out of the image forming apparatus by sheet ejection section 52 including sheet ejection rollers 52*a*.

Incidentally, it is known that, in image forming apparatus 1, cyclic density unevenness is caused in the sub scanning direction of the image due to the rotation runout of photoconductor drum 413 and developing sleeve 412A. When such density unevenness is caused, first portion S11 having a high color density and second portion S12 having a low color density are alternately formed in output image S1 when an image composed of one color is output to sheet S as illustrated in FIG. 1, for example. In particular, in the case of density unevenness due to the rotation runout of developing roller, first portion S11 and second portion S12 are formed at short intervals since the diameter of developing sleeve 412A is smaller than the diameter of photoconductor drum 413. Therefore, when density unevenness due to the rotation runout of developing sleeve 412A is caused, the density unevenness tends to be reflected in the image output on the sheet, and consequently precise correction of the density unevenness becomes necessary.

Figure 5:
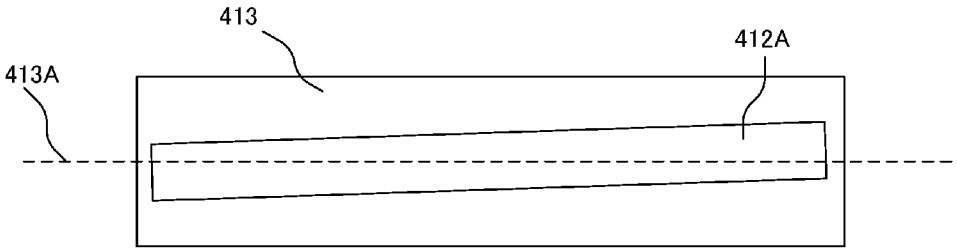
FIG. 5 illustrates a developing sleeve tilted to an axis line of a photoconductor drum.

However, as illustrated in FIG. 5, when the positions of both end portions of developing sleeve 412A in the axis direction at the holding part are shifted due to manufacturing error or the like in developing device 414 for example, developing sleeve 412A is tilted with respect to axis line 413A of photoconductor drum 413 in some situation. In this case, as illustrated in FIG. 2, when density unevenness due to rotation of developing sleeve 412A is caused at the time of output of an image composed of one color to sheet S, tilted density unevenness in which first portion S11 and second portion S12 are tilted with respect to the main scanning direction is caused. Even when the same correction value is used at all positions in the main scanning direction to correct the above-mentioned tilted density unevenness, the density unevenness of the all positions cannot be eliminated, and the tilted density unevenness cannot be precisely corrected, for example.

In view of this, in the present embodiment, control section 100 performs a first correction process. In the first correction process, control section 100 calculates a first correction amount for correcting density unevenness of the patch image in the sub scanning direction based on the detection result of density detection section 80, and calculates a second correction amount which is a correction amount for correcting density unevenness of the patch image at a plurality of main scanning positions in the main scanning direction based on the difference between the first correction amount and the detection result of two density detection sections 80. The second correction amount is different from the first correction amount in phase.

Figure 6:
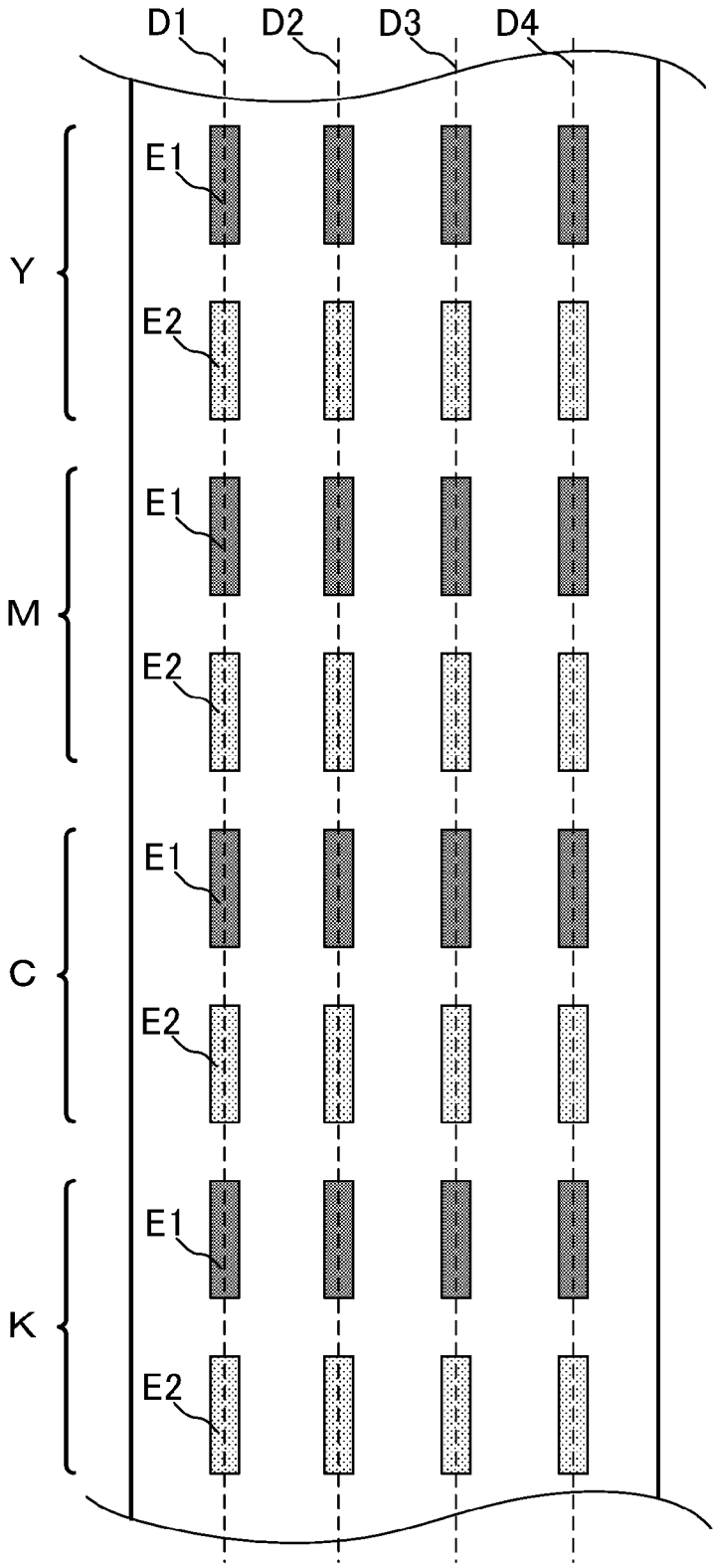
FIG. 6 illustrates patch images formed at four positions of an intermediate transfer belt in the main scanning direction.

As illustrated in FIG. 6, control section 100 controls image forming section 40 to form a first patch image corresponding to first predetermined rotation cycles (for example, 10 cycles) of developing sleeve 412A. The first patch image corresponds to "first toner image" of the embodiment of the present invention. The first patch image is formed based on the gradation, the color and the number of screens set in advance. FIG. 6 illustrates patch images of four colors of YMCK including first images E1 of a detection gradation of 75[%] and second images E2 of a detection gradation of 50[%].

Figure 7:
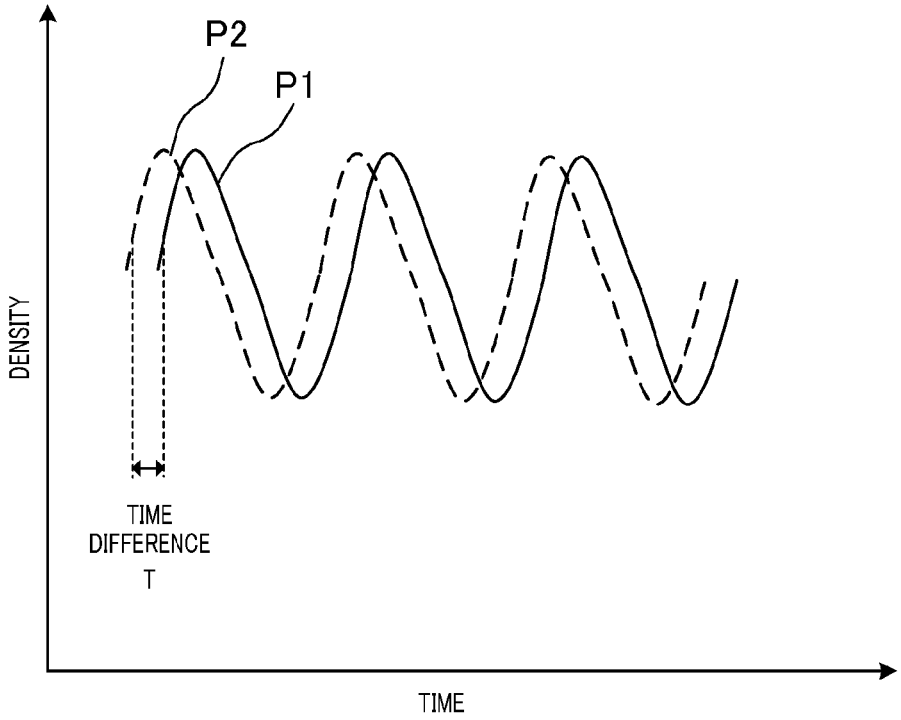
FIG. 7 shows a variation waveform of density detected by a density detection section.

As illustrated in FIG. 7, control section 100 detects the density of the first patch image with two density detection sections 80, and extracts first variation waveform P1 of the density at a position corresponding to position A of sheet S (see FIG. 2), and second variation waveform P2 of the density at a position corresponding to position B of sheet S (see FIG. 2).

First variation waveform P1 and second variation waveform P2 are variation waveforms having substantially the same shapes, and their phases are shifted by time difference T due to the influence of tilted density unevenness.

Figure 8:
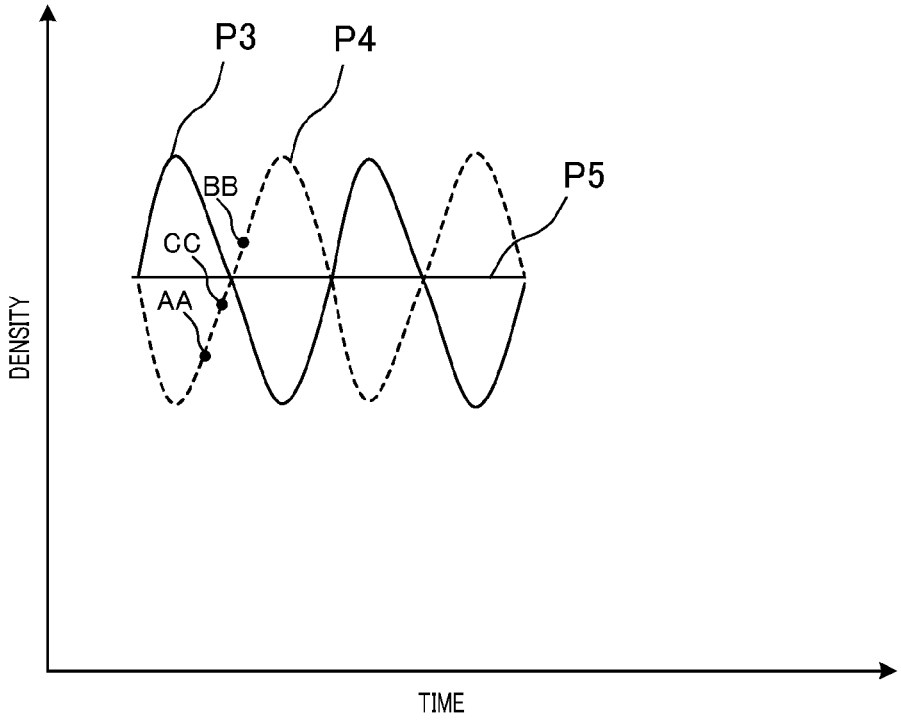
FIG. 8 illustrates a density unevenness waveform determined from two variation waveforms, and a correction waveform determined from the density unevenness waveform.

Control section 100 calculates time difference T between first variation waveform P1 and second variation waveform P2 and detects the phase shift between first variation waveform P1 and second variation waveform P2. Control section 100 corrects the phase shift, and adds together and averages the density values at the part where the phases of the variation waveforms are matched to thereby determine density unevenness waveform P3 for one cycle of developing sleeve 412A as illustrated in FIG. 8.

From density unevenness waveform P3, control section 100 determines correction waveform P4 for eliminating the density unevenness in density unevenness waveform P3. When the light exposure amount in image forming section 40, for example, exposing device 411, is controlled in such a manner as to provide the above-mentioned density unevenness in correction waveform P4, the density in the output image in the sub scanning direction can be set to constant value P5. After correction waveform P4 is determined, control section 100 stores correction waveform P4 in storage section 72. It is to be noted that correction waveform P4 corresponds to "first correction amount" of the embodiment of the present invention.

On the basis of the rotation cycle of developing sleeve 412A and the difference between the detection results of the detected variation waveforms, that is, the phase shift, control section 100 detects the correction amount on the correction waveform of the density which corresponds to a start time of image formation, that is, the phase position.

The following specifically describes a case where the phase position on correction waveform P4 corresponding to a start time of image formation at the main scanning direction position A (see FIG. 2) is position AA, and the phase position on correction waveform P4 corresponding to the start time at the main scanning direction position B (see FIG. 2) is position BB.

On the basis of the distance between position A and position B in the main scanning direction, and position AA and position BB on correction waveform P4, control section 100 estimates the phase position on correction waveform P4 for each main scanning position in the main scanning direction.

For example, control section 100 estimates that the phase position of the case where the main scanning position in the main scanning direction is position C (see FIG. 2) is position CC located between position AA and position BB on correction waveform P4 in consideration of the positional relationship between the position AA and position BB, and the distance relationship between position A and position B in the main scanning direction.

Then, at a start time of image formation, control section 100 determines the amount of variation of the phase of correction waveform P4 such that the phase position on correction waveform P4 applied to position C matches position CC. In this manner, control section 100 determines the amount of variation of the phase of correction waveform P4 at the main scanning positions with respect to position AA corresponding to position A where density detection section 80 is disposed, for example. After determining the amount of variation of the phase of correction waveform P4 for each main scanning position, control section 100 stores correction waveform P4 whose phase is shifted at each main scanning position in storage section 72. It is to be noted that the correction waveform whose phase is shifted at each main scanning position corresponds to "second correction amount" of the embodiment of the present invention.

In this manner, by applying correction waveform P4 whose phase is shifted at each main scanning position, even the tilted density unevenness can be precisely corrected.

Figure 9:
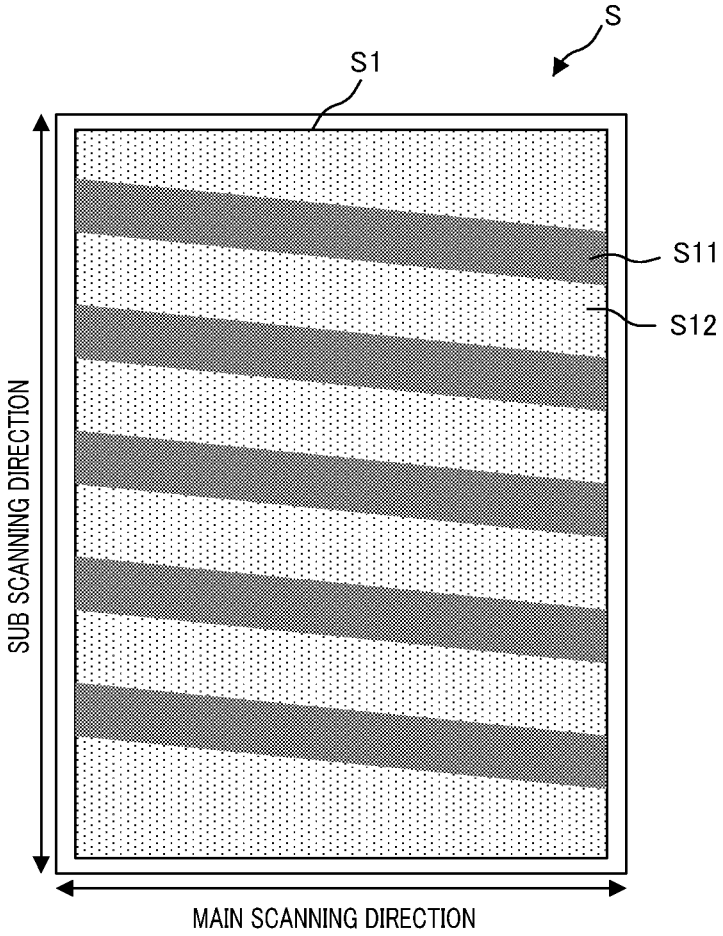
FIG. 9 illustrates a state where density unevenness tilted to the main scanning direction is caused in the sheet after replacement of the photoconductor unit.

Incidentally, when photoconductor drum 413 which holds the photoconductor unit is replaced, the positional relationship between developing sleeve 412A and photoconductor drum 413 may be changed from the state before the replacement. In this case, when density unevenness due to rotation of developing sleeve 412A is caused, output image S1 having first portion S11 and second portion S12 having an inclination angle different from that of FIG. 2 is output to output to sheet S as illustrated in FIG. 9, for example. In this manner, when different types of tilted density unevenness which differ between before and after the replacement of the photoconductor unit are generated, it is necessary to again correct the inclination density unevenness after the replacement.

However, the density unevenness waveform of density unevenness due to rotation of developing sleeve 412A in the sub scanning direction depends on the inclination of developing sleeve 412A, and therefore the waveform does not change until developing device 412 including developing sleeve 412A is replaced.

In view of this, in the present embodiment, in the case where the density unevenness is again corrected after the first correction process, control section 100 executes the second correction process in which the second correction amount, that is, correction waveform P4 whose phase is shifted at each main scanning position is calculated with use of the already calculated first correction amount, that is, correction waveform P4 stored in storage section 72.

When executing the second correction process, control section 100 controls image forming section 40 to form a second patch image which corresponds to a second predetermined rotation cycle (for example, two cycles) of developing sleeve 412A and whose length in the sub scanning direction is smaller than that of the first patch image. The second patch image corresponds to "second toner image" of the embodiment of the present invention.

As illustrated in FIG. 7, control section 100 extracts first variation waveform P1 and second variation waveform P2 by the second patch image, and calculates time difference T therebetween. Control section 100 detects the phase shift between first variation waveform P1 and second variation waveform P2 based on time difference T. On the basis of the rotation cycle of developing sleeve 412A and the phase shift, control section 100 changes the phase of correction waveform P4 at each main scanning position as in the first correction process.

At the time of executing the first correction process, the period of the variation waveform of the density unevenness is unknown, and it is therefore necessary to form the first patch image corresponding to the first predetermined rotation cycle which is a relatively long period.

In contrast, at the time of executing the second correction process, the period of the variation waveform of the density unevenness is known. That is, correction waveform P4 based on the inclination of developing sleeve 412A is already determined, and therefore it is only necessary to detect the phase shift between first variation waveform P1 and second variation waveform P2. Since the period of the variation waveform of the density unevenness is not changed as long as the inclination of developing sleeve 412A is not changed, the phase shift can be sufficiently detected only by forming the second patch image corresponding to the second predetermined rotation cycle which is a relatively short period. Therefore, when the photoconductor unit is replaced, the toner amount required for again correcting the tilted density unevenness can be reduced in comparison with the state before replacement of the photoconductor unit.

Figure 10:
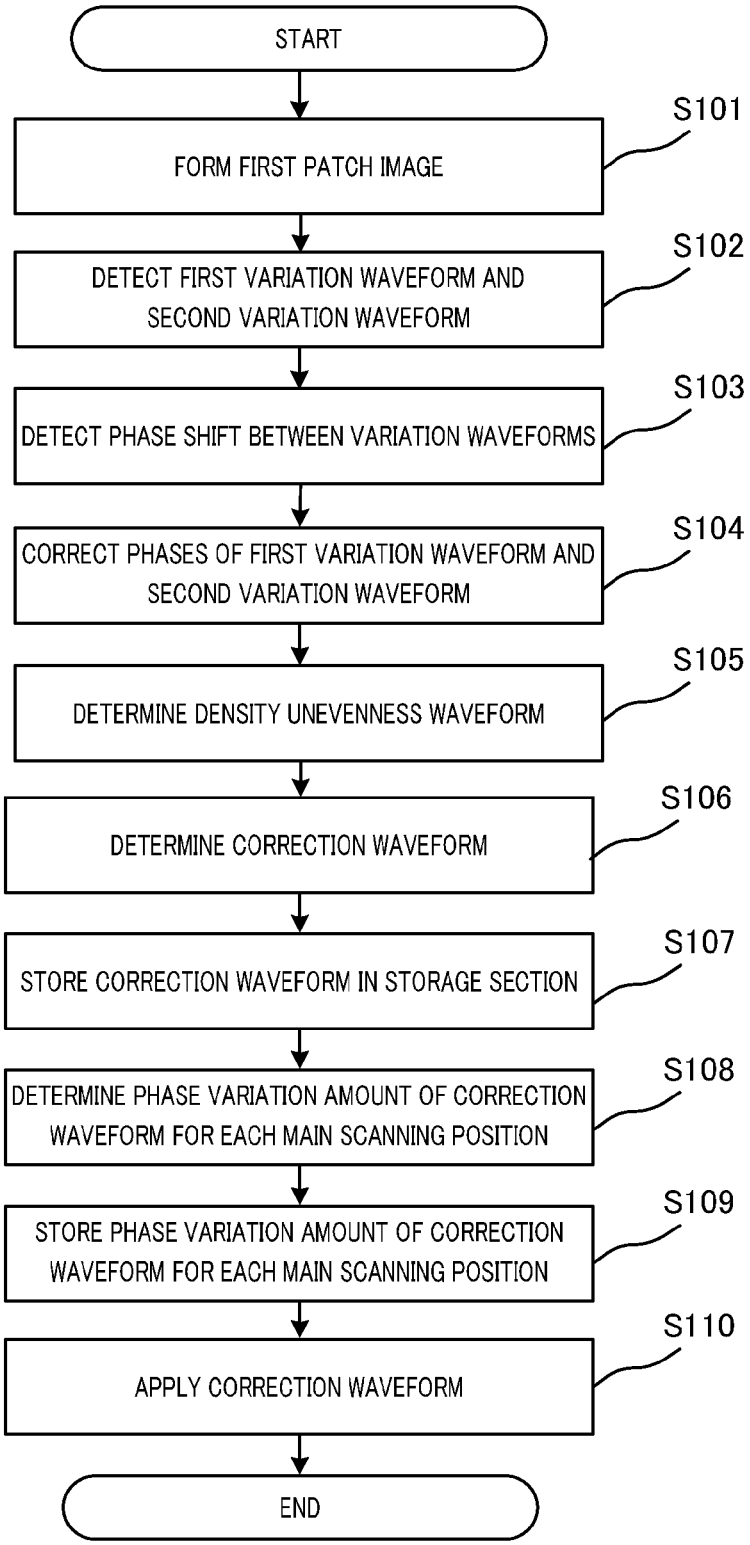
FIG. 10 is a flowchart of an example operation at the time of executing a first correction process of density unevenness correction in the image forming apparatus.

Next, an example operation at the time of executing the first correction process for density unevenness correction in image forming apparatus 1 having the above-mentioned control section 100 will be described. FIG. 10 is a flowchart of an example operation at the time of executing the first correction process for density unevenness correction in image forming apparatus 1. The process of FIG. 10 is executed when an execution request of a printing job is received by control section 100 in the case where correction waveform P4 is not stored in storage section 72.

First, control section 100 controls image forming section 40 to form a first patch image (step S101). Control section 100 detects from the first patch image first variation waveform P1 and second variation waveform P2 detected by density detection section 80 (step S102).

Next, control section 100 detects the phase shift between first variation waveform P1 and second variation waveform P2 (step S103). Next, control section 100 corrects the phases of first variation waveform P1 and second variation waveform P2 (step S104). Control section 100 determines density unevenness waveform P3 by averaging (step S105).

Next, control section 100 determines correction waveform P4 from density unevenness waveform P3 (step S106). Control section 100 stores correction waveform P4 in storage section 72 (step S107).

Next, control section 100 determines the amount of variation of the phase of correction waveform P4 for each main scanning position (step S108). Next, control section 100 stores the amount of variation of the phase in storage section 72 for each main scanning position (step S109). Then, control section 100 applies correction waveform P4, that is, controls the image formation condition such that the correction value based on correction waveform P4 is set (step S110), and terminates this control.

Figure 11:
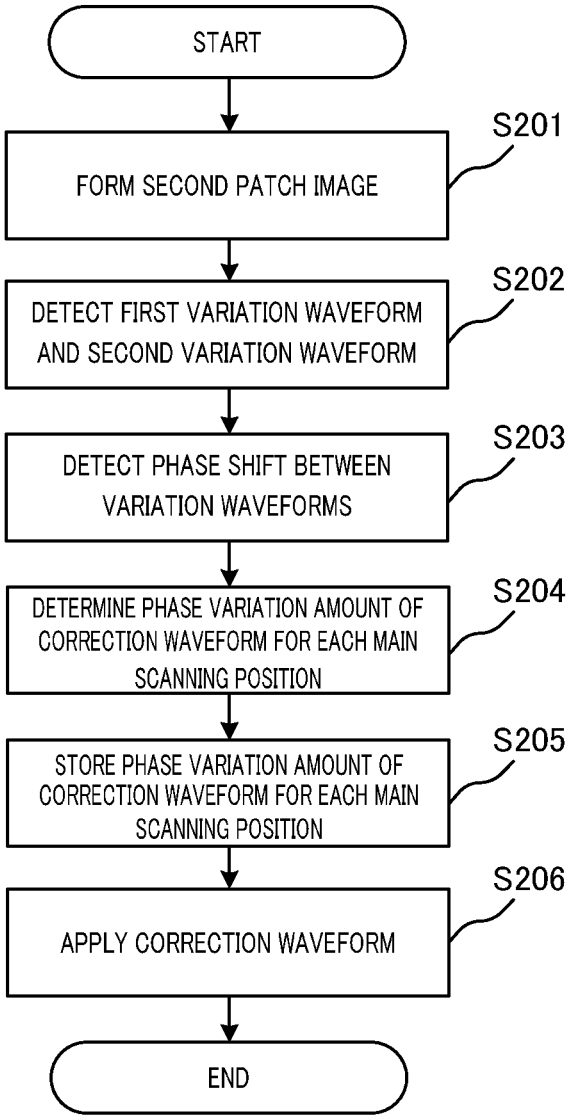
FIG. 11 is a flowchart of an example operation at the time of executing a second correction process of density unevenness correction in the image forming apparatus.

Next, an example operation at the time of executing the second correction process of the density unevenness correction in image forming apparatus 1 will be described. FIG. 11 is a flowchart of an example operation at the time of executing the second correction process of the density unevenness correction in image forming apparatus 1. The process of FIG. 11 is executed when an execution request of a printing job is received by control section 100 in the case where correction waveform P4 is stored in storage section 72, that is, after the photoconductor unit is replaced.

First, control section 100 controls image forming section 40 to form the second patch image (step S201). Control section 100 detects from the second patch image first variation waveform P1 and second variation waveform P2 (step S202).

Next, control section 100 calculates the phase shift between first variation waveform P1 and second variation waveform P2 (step S203). Next, control section 100 determines the amount of variation of the phase of correction waveform P4 for each main scanning position (step S204). Control section 100 stores the amount of variation of the phase storage section 72 for each main scanning position (step S205).

Then, control section 100 controls the image formation condition so as to apply correction waveform P4 (step S206), and terminates this control.

As described above, image forming apparatus 1 of the embodiment of the present invention includes: image forming section 40 including photoconductor drum 413 and toner photoconductor drum 413 configured to supply toner to photoconductor drum 413, image forming section 40 being configured to attach the toner to photoconductor drum 413 to form a toner image; density detection section 80 configured to detect density of the toner image formed on photoconductor drum 413 in a sub scanning direction at a plurality of positions in a main scanning direction orthogonal to the sub scanning direction, the sub scanning direction being a rotational direction of photoconductor drum 413; and control section 100 configured to perform a first correction process in which a first correction amount is calculated based on a detection result of density detection section 80 and a second correction amount is calculated based on a difference between the calculated first correction amount and the detection result of density detection section 80 at the plurality of positions, the first correction amount being configured for correcting density unevenness of the toner image caused in the sub scanning direction, the second correction amount being a correction amount for correcting density unevenness of the toner image at a plurality of main scanning positions in the main scanning direction, the second correction amount being different from the first correction amount in phase.

According to the above-mentioned configuration of the present embodiment, it is possible to apply correction waveform P4 whose phase is shifted for each main scanning position, and thus density unevenness can be precisely corrected even when the tilted density unevenness is generated.

In addition, since correction waveform P4 is determined based on the rotation cycle of developing sleeve 412A, correction waveform P4 can be easily matched with the density unevenness when density unevenness due to rotation runout of developing sleeve 412A is generated. Thus, it is possible to precisely correct the density unevenness due to rotation runout of developing sleeve 412A which is relatively easily reflected on the output image is caused.

In addition, in the present embodiment, in the case where the positional relationship between developing sleeve 412A and photoconductor drum 413 is changed due to replacement of photoconductor drum 413 and the density-unevenness correction is required to be again performed, correction waveform P4 determined in the first correction process which has been executed is used to execute the second correction process. In this manner, the density unevenness can be corrected only by forming the second patch image whose length in the sub scanning direction is smaller than that of the first patch image, and therefore, in the case where the photoconductor unit is replaced, the toner amount required for again correcting the tilted density unevenness can be reduced.

While correction waveform P4 is calculated from the variation waveforms detected by two density detection sections 80 in the above-mentioned embodiment, the present invention is not limited to this. For example, correction waveform P4 may be calculated from the variation waveform detected by one of the two density detection sections 80, or may be calculated from the variation waveforms detected by three or more density detection sections 80.

Finally, an experiment for evaluating image forming apparatus 1 according to the present embodiment will be described.

In this experiment, image forming apparatus 1 illustrated in FIG. 3 was used to confirm whether inclination density unevenness can be corrected under a condition which causes tilted density unevenness.

The condition of the experiment was as follows. The outer diameter of developing sleeve 412A was set to 25 [mm], the process linear velocity was set to 325 [mm/sec], the number of prints of the lifetime of the photoconductor unit was set to 200,000, the outer diameter of photoconductor drum 413 was set to 60 [mm], and the number of prints of the lifetime of developing device 412 was set to 2,400,000.

As illustrated in FIG. 6, as the patch images, first images E1 of a detection gradation of 75[%] and second images E2 of a detection gradation of 50[%] were formed for four colors of YMCK in three screens which correspond to ten cycles of developing sleeve 412A. It is to be noted that FIG. 6 illustrates the patch images of one screen.

In addition, in the patch image, the toner adhesion amount is 6 [g/m$^2$] when the gradation is 100[%], and the length is 480 [mm], and the width is 20 [mm]. It is to be noted that, in FIG. 6, the lengths of first image E1 and second image E2 are reduced with respect to the width for illustration purpose.

Density-unevenness correction was assessed under the above-mentioned condition. In Example 1, the variation patterns of the density unevenness in the sub scanning direction were detected at position D1, position D2, position D3, and position D4 in the main scanning direction in FIG. 6 to execute the first correction process. In Comparative example 1, the variation pattern of the density unevenness in the sub scanning direction was detected only at position D2 to execute the first correction process. In Comparative example 2, the density unevenness was not corrected.

Table 1 shows results of the experiment of the assessment of density-unevenness correction.

TABLE 1

| | Assessment of density-unevenness correction | | | |
|---|---|---|---|---|
| | D1 | D2 | D3 | D4 |
| Ex. 1 | good | good | good | good |
| Comp. EX. 1 | poor | good | poor | poor |
| Comp. EX. 1 | poor | poor | poor | poor |

In Table 1, "good" indicates that density unevenness was completely corrected, and "poor" indicates that density unevenness could not be corrected.

As shown in Table 1, in Comparative example 1, the density unevenness was corrected at position D2, but the density unevenness could not be corrected at other three positions. In contrast, in Example 1, it was confirmed that the density unevenness was corrected at all positions. That is, it was confirmed that the ease of the density unevenness correction increases as the number of the positions for detecting the density unevenness variation waveform increases.

Next, the amount of the toner consumed by the correction during the lifetime of developing device 412 (2,400,000 sheets) was confirmed. In this experiment, the photoconductor unit was replaced 11 times during the printing process since the life of the photoconductor unit is 200,000 prints.

Then, in addition to Example 1 and Comparative example 1, the result of the density unevenness determination and the toner consumption amount were confirmed in Example 2. In Example 2, after the first correction process is executed by detecting the variation waveform of the density unevenness in the sub scanning direction at position D1, position D2, position D3, and position D4, the second correction process is executed using the process correction waveform determined in the initial first correction after replacement of the photoconductor unit.

In Comparative example 1, the patch image is formed only at position D2. In Example 1, the first correction process is executed at all times regardless whether the photoconductor unit has been replaced.

In Example 2, the first correction process is executed under the same condition as that of Example 1 until the number of prints reaches 200,000, and, after the number of prints reaches 200,000 and the photoconductor unit is replaced, the second correction process is executed at the time when the density-unevenness correction is again performed.

As the patch images at the time of executing the second correction process in Example 2, only first images E1 of a detection gradation of 75[%] were formed for each color in one screen were used as the measurement pattern. At this time, first image E1 was set to have a length of 40 [mm] and a width of 20 [mm].

In addition, the detection position in the main scanning direction at the time of executing the second correction process was any one of position D1, position D2, position D3, and position D4. In this case, the patch image was formed only at the detection position.

Table 2 shows the result of the determination of the density unevenness based on the number of prints and the amount of the toner consumed by the correction during the lifetime of developing device 412.

TABLE 2

| | Assessment of density-unevenness correction | | | | | Toner consumption amount |
|---|---|---|---|---|---|---|
| | 200000 sheets | 400000 sheets | 600000 sheets | 800000 sheets | 2400000 sheets | |
| Ex. 1 | poor | poor | poor | poor | poor | 10.368 g |
| Comp. EX. 1 | good | good | good | good | good | 41.472 g |
| Comp. EX. 1 | good | good | good | good | good | 3.962 g |

In Table 2, "good" indicates that density unevenness was completely corrected, and "poor" indicates that density unevenness could not be corrected.

It was confirmed from the results shown in Table 2 that, in Example 1 and example 2, the density unevenness is corrected even when the number of prints reaches 2,400,000. In addition, it was confirmed that the toner consumption amount was reduced to 3,962 [g] in Example 2 while the toner consumption amount was 10,368 [g] in Comparative example 1 and 41,472 [g] in Example 1. That is, it was confirmed that the toner consumption amount can be considerably reduced in Example 2 in comparison with other examples.

The embodiments disclosed herein are merely exemplifications and should not be considered as limitative. While the invention made by the present inventor has been specifically described based on the preferred embodiments, it is not intended to limit the present invention to the above-mentioned preferred embodiments but the present invention may be further modified within the scope and spirit of the invention defined by the appended claims.

The present invention is applicable to an image forming system composed of a plurality of units including an image forming apparatus. The units include, for example, a post-processing apparatus, an external apparatus such as a control apparatus connected with a network, and the like.

What is claimed is:

1. An image forming apparatus comprising:

an image forming section including an image bearing member and a developer bearing member configured to supply toner to the image bearing member, the image forming section being configured to attach the toner to the image bearing member to form a toner image;

a plurality of density detection sections configured to detect density in a sub scanning direction of the toner image formed on the image bearing member at a plurality of respective positions in a main scanning direction orthogonal to the sub scanning direction, the sub scanning direction being a rotational direction of the image bearing member; and a density-unevenness correction section configured to perform a first correction process in which a first correction amount is calculated based on a detection result of one of the density detection sections and a second correction amount is calculated based on a difference between the calculated first correction amount and the detection result of another of the density detection sections, the first correction amount being configured for correcting density unevenness of the toner image caused in the sub scanning direction, the second correction amount being a correction amount for correcting density unevenness of the toner image at a plurality of main scanning positions in the main scanning direction, the second correction amount being different from the first correction amount in phase, wherein the density-unevenness correction section performs a second correction process in which a third correction amount is calculated based on the calculated first correction amount and a detection result of the density detection section on a second toner image which differs from a first toner image which is used to perform the first correction process, and wherein the density-unevenness correction section controls the image forming section such that a length of the second toner image in the sub scanning direction is smaller than a length of the first toner image in the sub scanning direction.

2. The image forming apparatus according to claim 1 further comprising a cycle detection section configured to detect a rotation cycle of the developer bearing member, wherein:

the plurality of the density detection sections are disposed side by side in the main scanning direction; and the density-unevenness correction section detects correction amounts of respective positions of the density detection sections in the main scanning direction based on a rotation cycle detected by the cycle detection section and detection results of the density detection sections, and calculates a correction amount of positions where the density detection sections are not disposed based on the detected correction amounts.

3. The image forming apparatus according to claim 2, wherein the density-unevenness correction section calculates the first correction amount based on the rotation cycle detected by the cycle detection section and at least one of the detection results of the density detection sections.

4. The image forming apparatus according to claim 3, wherein the density-unevenness correction section calculates the first correction amount to eliminate the density unevenness of the detection results of the density detection section.

5. An image formation system composed of a plurality of units including an image forming apparatus, the image formation system comprising:

an image forming section including an image bearing member and a developer bearing member configured to supply toner to the image bearing member, the image forming section being configured to attach the toner to the image bearing member to form a toner image;

a plurality of density detection sections configured to detect density in a sub scanning direction of the toner image formed on the image bearing member at a plurality of respective positions in a main scanning direction orthogonal to the sub scanning direction, the sub scanning direction being a rotational direction of the image bearing member; and a density-unevenness correction section configured to perform a first correction process in which a first correction amount is calculated based on a detection result of one of the density detection sections and a second correction amount is calculated based on a difference between the calculated first correction amount and the detection result of the another of the density detection sections, the first correction amount being configured for correcting density unevenness of the toner image caused in the sub scanning direction, the second correction amount being a correction amount for correcting density unevenness of the toner image at a plurality of main scanning positions in the main scanning direction, the second correction amount being different from the first correction amount in phase, wherein the density-unevenness correction section performs a second correction process in which a third correction amount is calculated based on the calculated first correction amount and a detection result of the density detection section on a second toner image which differs from a first toner image which is used to perform the first correction process, and wherein the density-unevenness correction section controls the image forming section such that a length of the second toner image in the sub scanning direction is smaller than a length of the first toner image in the sub scanning direction.

6. A density-unevenness correction method of an image forming apparatus including an image forming section including an image bearing member and a developer bearing member configured to supply toner to the image bearing member, the image forming section being configured to attach the toner to the image bearing member to form a toner image, the method comprising:

detecting density in a sub scanning direction of the toner image formed on the image bearing member at a plurality of positions in a main scanning direction orthogonal to the sub scanning direction, the sub scanning direction being a rotational direction of the image bearing member;

performing a first correction process in which a first correction amount is calculated based on a detection result of the density at one of the plurality of positions and a second correction amount is calculated based on a difference between the calculated first correction amount and the detection result of the density at another of the plurality of positions, the first correction amount being configured for correcting density unevenness of the toner image caused in the sub scanning direction, the second correction amount being a correction amount for correcting density unevenness of the toner image at a plurality of main scanning positions in the main scanning direction, the second correction amount being different from the first correction amount in phase; and performing a second correction process in which a third correction amount is calculated based on the calculated first correction amount and a detection result of the density on a second toner image which differs from a first toner image which is used to perform the first correction process, wherein the image forming section is controlled such that a length of the second toner image in the sub scanning direction is smaller than a length of the first toner image in the sub scanning direction.

7. The density-unevenness correction method according to claim 6, further comprising detecting a rotation cycle of the developer bearing member, wherein correction amounts of respective positions in the main scanning direction are detected based on a detected rotation cycle and detection results of the density, and a correction amount of positions where the density is not detected is calculated based on the detected correction amounts.

8. The density-unevenness correction method according to claim 7, wherein the first correction amount is calculated based on the detected rotation cycle and at least one of the detection results of the density.

9. The density-unevenness correction method according to claim 8, wherein the first correction amount is calculated to eliminate the density unevenness of the detection results of the density.

10. A non-transitory computer-readable recording medium storing a program of an image forming apparatus including an image forming section including an image bearing member and a developer bearing member configured to supply toner to the image bearing member, the image forming section being configured to attach the toner to the image bearing member to form a toner image, wherein the recording medium causes a computer of the image forming apparatus to detect density in a sub scanning direction of the toner image formed on the image bearing member at a plurality of positions in a main scanning direction orthogonal to the sub scanning direction, the sub scanning direction being a rotational direction of the image bearing member;

perform a first correction process in which a first correction amount is calculated based on a detection result of the density at one of the plurality of positions and a second correction amount is calculated based on a difference between the calculated first correction amount and the detection result of the density at another of the plurality of positions, the first correction amount being configured for correcting density unevenness of the toner image caused in the sub scanning direction, the second correction amount being a correction amount for correcting density unevenness of the toner image at a plurality of main scanning positions in the main scanning direction, the second correction amount being different from the first correction amount in phase;

perform a second correction process in which a third correction amount is calculated based on the calculated first correction amount and a detection result of the density on a second toner image which differs from a first toner image which is used to perform the first correction process; and control the image forming section such that a length of the second toner image in the sub scanning direction is smaller than a length of the first toner image in the sub scanning direction.

11. The non-transitory recording medium according to claim 10, wherein the recording medium causes the computer of the image forming apparatus to detect a rotation cycle of the developer bearing member, and detect correction amounts of respective positions in the main scanning direction based on a detected rotation cycle and detection results of the density, and calculate a correction amount of positions where the density is not detected based on the detected correction amounts.

12. The non-transitory recording medium according to claim 11, wherein the recording medium causes the computer of the image forming apparatus to calculate the first correction amount based on the detected rotation cycle and at least one of the detection results of the density.

13. The non-transitory recording medium according to claim 12, wherein the recording medium causes the computer of the image forming apparatus to calculate the first correction amount to eliminate the density unevenness of the detection results of the density.

* * * * *